US010054892B2

(12) United States Patent
Tokuma

(10) Patent No.: US 10,054,892 B2
(45) Date of Patent: Aug. 21, 2018

(54) SHEET PROCESSING APPARATUS AND IMAGE FORMING APPARATUS

(71) Applicant: CANON KABUSHIKI KAISHA, Tokyo (JP)

(72) Inventor: Naoto Tokuma, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 45 days.

(21) Appl. No.: 15/261,060

(22) Filed: Sep. 9, 2016

(65) Prior Publication Data

US 2017/0075284 A1 Mar. 16, 2017

(30) Foreign Application Priority Data

Sep. 14, 2015 (JP) ..... 2015-181160

(51) Int. Cl.

| | |
|---|---|
| ***B65H 45/18*** | (2006.01) |
| ***G03G 15/00*** | (2006.01) |
| ***B65H 45/30*** | (2006.01) |
| ***B65H 37/04*** | (2006.01) |
| ***B65H 37/06*** | (2006.01) |

(52) U.S. Cl.

CPC ..... *G03G 15/6541* (2013.01); *B65H 37/04* (2013.01); *B65H 37/06* (2013.01); *B65H 45/18* (2013.01); *B65H 45/30* (2013.01); *B65H 2511/30* (2013.01); *B65H 2513/10* (2013.01); *B65H 2513/104* (2013.01); *B65H 2513/11* (2013.01); *B65H 2801/27* (2013.01)

(58) Field of Classification Search

CPC ..... B41L 43/12; B65H 37/04; B65H 45/12; B65H 45/18; B31B 1/52; B31B 2201/25; B31B 2201/267; B31F 1/08; B31F 2301/4505

USPC ..... 270/37, 45, 58.07, 58.08; 493/396–403, 493/435, 444, 445

See application file for complete search history.

(56) References Cited

U.S. PATENT DOCUMENTS

| | | | | |
|---|---|---|---|---|
| 6,003,853 | A | 12/1999 | Nakazawa et al. | |
| 6,997,449 | B2 | 2/2006 | Obuchi et al. | |
| 7,597,311 | B2 * | 10/2009 | Kawata | B65H 45/18 270/12 |

(Continued)

FOREIGN PATENT DOCUMENTS

| | | | |
|---|---|---|---|
| CN | 101314445 | A | 12/2008 |
| JP | 2001002317 | A | 1/2001 |

(Continued)

*Primary Examiner* — Leslie A Nicholson, III

(74) *Attorney, Agent, or Firm* — Canon U.S.A., Inc. IP Division

(57) ABSTRACT

A sheet processing apparatus includes a creasing unit; a support supporting a sheet on which a crease has been formed, a folding roller folding the sheet supported by the support while rotating at a folding speed, a thrusting member moving at a thrust speed higher than the folding speed, and to thrust the sheet such that the sheet is folded at a position where the crease has been formed, and a control unit performing control such that a difference between a folding speed of the folding roller and a thrust speed of the thrusting member, in a case in which the folding roller folds a first number of sheets, is smaller than a difference between the folding speed and the thrust speed, in a case in which the folding roller folds a second number of sheets that is larger than the first number of sheets.

13 Claims, 14 Drawing Sheets

(56) References Cited

U.S. PATENT DOCUMENTS

| | | | | |
|---|---|---|---|---|
| 7,740,238 | B2 * | 6/2010 | Iijima | B42B 4/00 270/32 |
| 7,770,876 | B2 * | 8/2010 | Sasahara | B31F 1/08 270/20.1 |
| 7,891,647 | B2 * | 2/2011 | Nakane | B42C 1/12 270/10 |
| 8,240,651 | B2 * | 8/2012 | Mitani | B65H 45/18 270/37 |
| 8,322,701 | B2 * | 12/2012 | Hattori | B65H 37/06 270/20.1 |
| 8,419,003 | B2 * | 4/2013 | Kojima | B65H 5/062 270/45 |
| 8,480,069 | B2 * | 7/2013 | Shibasaki | B31F 1/0012 270/37 |
| 2006/0128543 | A1 | 6/2006 | Sekine | |
| 2008/0185763 | A1 | 8/2008 | Iguchi | |
| 2012/0046154 | A1 | 2/2012 | Takeuchi et al. | |
| 2012/0083400 | A1 | 4/2012 | Shibasaki et al. | |
| 2012/0086161 | A1 | 4/2012 | Nagasako et al. | |
| 2012/0142510 | A1 | 6/2012 | Ishikawa et al. | |
| 2013/0087965 | A1 | 4/2013 | Shimizu | |
| 2014/0203488 | A1 | 7/2014 | Hidaka et al. | |
| 2016/0313687 | A1 * | 10/2016 | Osada | G03G 15/6541 |

FOREIGN PATENT DOCUMENTS

| | | | | |
|---|---|---|---|---|
| JP | 2002308521 | A | | 10/2002 |
| JP | 2003054832 | A | | 2/2003 |
| JP | 2004099187 | A | | 4/2004 |
| JP | 2007076832 | A | * | 3/2007 |
| JP | 2011241021 | A | | 12/2011 |
| JP | 2013184802 | A | * | 9/2013 |
| JP | 2014227236 | A | | 12/2014 |

* cited by examiner

FIG. 13

| NUMBER OF SHEETS IN STACK | THRUST SPEED | CREASE FORMED | NO CREASE FORMED |
|---|---|---|---|
| ONE SHEET | 100% | ×1,2 | ○ |
| | 70% | ×1 | ○ |
| | 50% | ○ | ○ |
| TWO SHEETS | 100% | ×1 | ○ |
| | 70% | ○ | ○ |
| | 50% | ○ | ○ |
| THREE SHEETS OR MORE | 100% | ○ | ○ |
| | 70% | ○ | ○ |
| | 50% | ×3 | ×3 |

×1 THRUST PLATE MARK ×2 BACK CRACK ×3 TEAR IN COVER SHEET

SHEET PROCESSING APPARATUS AND IMAGE FORMING APPARATUS

BACKGROUND OF THE INVENTION

Field of the Invention

The present disclosure relates to a sheet processing apparatus for processing sheets.

Description of the Related Art

A technique for the folding of a stack of sheets using folding rollers, by pushing the stack of sheets into a nip between the folding rollers with a thrusting member is known (Japanese Patent Laid-Open No. 2011-241021).

A technique for the pressing of a folding portion of the sheet in a linear manner in advance so as to prevent the problem of the cracking of a back portion on an outer side of a folded sheet (hereinafter, referred to as a back crack), from occurring is also known (Japanese Patent Laid-Open No. 2014-227236).

There is a case in which, when a stack of sheets is pushed into a nip portion between folding rollers with a thrusting member, that only a sheet (a cover sheet) among the stack of sheets that is in contact with the folding rollers is conveyed by the folding rollers causing the sheet to be torn (hereinafter referred to as a tear of the cover sheet). It is desirable that a moving velocity (hereinafter referred to as a thrust speed) of the thrusting member is high in order to prevent the tearing of the cover sheet from occurring. However, when the thrust speed is high, a mark (a thrust plate mark) on the sheet, caused by the action of the thrusting member, may occur when the position where the crease is formed and the thrusting position deviate from each other.

SUMMARY OF THE INVENTION

The present invention provides a sheet processing apparatus including a creasing unit arranged to form a crease on a sheet, a support arranged to support the sheet on which the crease has been formed by the creasing unit, a folding roller arranged to fold the sheet supported by the support while rotating at a folding speed, a thrusting member arranged to move at a thrust speed, which is higher than the folding speed, and to thrust the sheet supported by the support towards the folding roller such that the sheet on which the crease has been formed is folded by the folding roller at a position where the crease has been formed, and a control unit arranged to control the thrusting member and the folding roller such that a speed difference between a folding speed of the folding roller and a thrust speed of the thrusting member, in a case in which the folding roller folds a first number of sheets including the sheet on which the crease has been formed, is smaller than a speed difference between the folding speed of the folding roller and the thrust speed of the thrusting member, in a case in which the folding roller folds a second number of sheets, the second number of sheets being larger than the first number of sheets, including the sheet on which the crease has been formed.

Further features of the present invention will become apparent from the following description of exemplary embodiments with reference to the attached drawings.

BRIEF DESCRIPTION OF THE DRAWINGS

FIG. 13 is a diagram illustrating an experiment result.

DESCRIPTION OF THE EMBODIMENTS

Configuration of Printer

Figure 1:
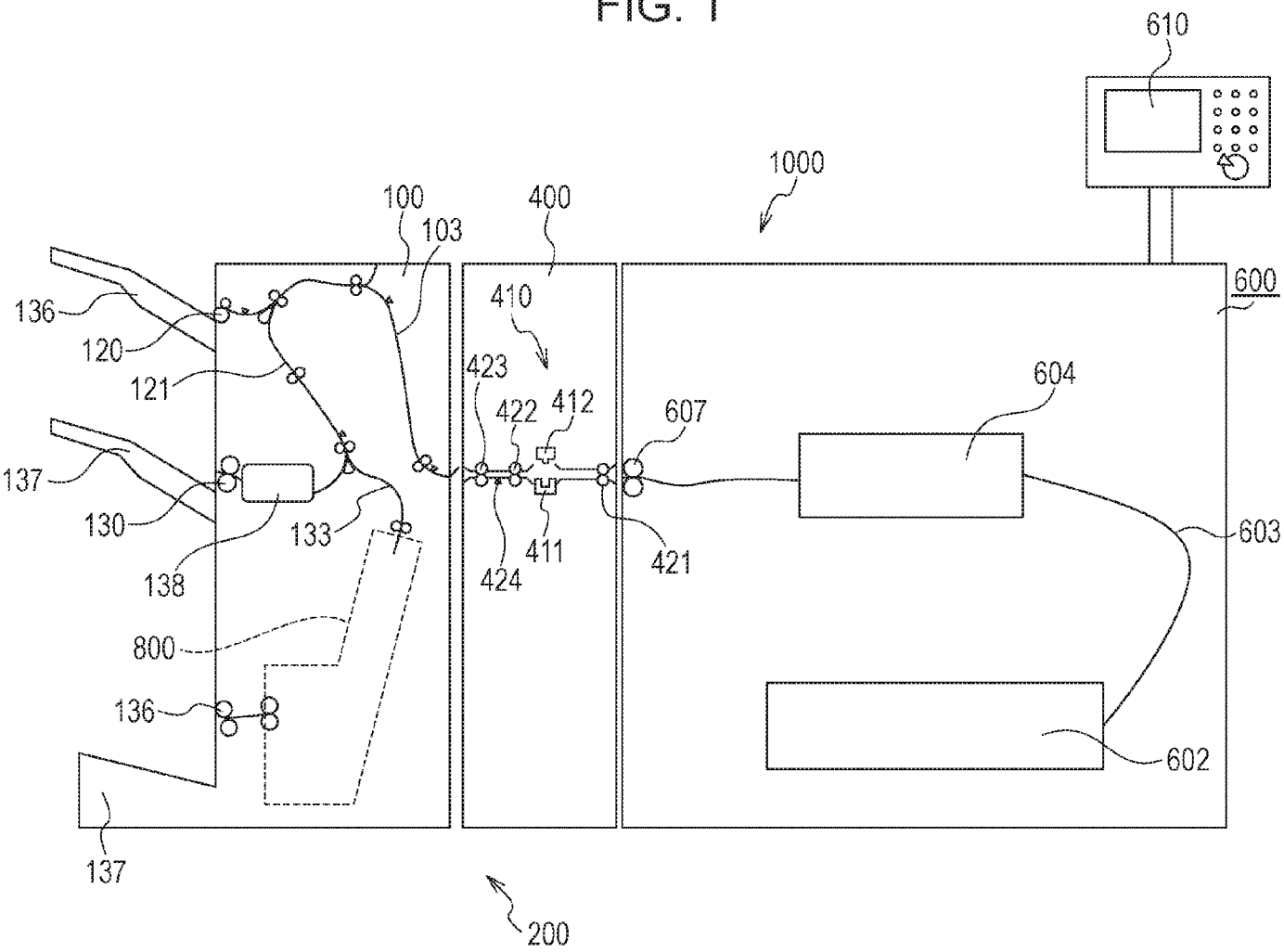
FIG. 1 is a cross-sectional view of an image forming apparatus according to the present disclosure.

An overall configuration of a printer 1000 serving as an image forming apparatus will be described with reference to FIG. 1. FIG. 1 is a cross-sectional view schematically illustrating the printer 1000 according to an exemplary embodiment of the present disclosure.

The printer 1000 includes a printer main body 600 that forms an image on a sheet, and a sheet processing apparatus 200.

The sheet processing apparatus 200 is configured so as to be detachable from the printer main body 600. The sheet processing apparatus 200 is mounted on the printer main body 600, the printer main body 600 capable of being used alone, as an option.

Note that in the present exemplary embodiment, description will be given using a detachable sheet processing apparatus 200; however, the sheet processing apparatus 200 and the printer main body 600 may be integral. Furthermore, in the following description, the position where a user faces an operation unit 610 to perform various input/setting operations on the printer 1000 is referred to as a "front side" of the printer 1000, and the rear side of the apparatus is referred to as a "back side". In other words, FIG. 1 illustrates a configuration of the printer 1000 viewed from the front side. The sheet processing apparatus 200 is connected to a lateral portion of the printer main body 600.

The printer main body 600 includes a sheet storing unit 602 that stores sheets therein, and a feeding path 603 that conveys a sheet fed from the sheet storing unit 602. Furthermore, the printer main body 600 includes an image forming unit 604 serving as an image forming member that forms an image on a sheet S fed through the feeding path 603. The sheet S on which an image has been formed with the image forming unit 604 is conveyed from the printer main body 600 to the sheet processing apparatus 200 with a discharge roller 607.

Overall Configuration of Sheet Processing Apparatus

The sheet processing apparatus 200 includes a creasing device 400 and a finisher 100.

The creasing device 400 includes pairs of conveyance rollers 421, 422, and 423 that convey the sheet sent from the printer main body 600, a detection sensor 424 that detects the sheet, and a creasing unit 410 that performs creasing on the sheet. The creasing unit 410 includes an upper member 412 that is provided with a projection portion and that is capable of moving up and down, and a lower member 411 provided with a recess portion corresponding to the projection portion. The upper member 412 receiving a drive from a creasing motor moves up and down. The projection portion of the upper member 412 extends in a sheet width direction that is orthogonal to a sheet conveyance direction. The recess portion of the lower member 411 extends in the sheet width direction that is orthogonal to the sheet conveyance direction. The recess portion of the lower member 411 is disposed so as to be capable of being fitted into the projection portion of the upper member 412.

The finisher 100 is a device that performs a finishing process on the sheet that has been sent from the creasing device 400.

The finisher 100 includes a conveyance path 103 that receives and conveys the sheet that has been sent from the creasing device 400. The sheet S that has been conveyed to the conveyance path 103 is discharged to an upper stacking tray 136 by a pair of discharge rollers 120.

A conveyance path 121 branches from the conveyance path 103. The conveyance path 121 guides the sheet to a processing unit 138. The processing unit 138 performs finishing processes, such as a binding process binding the sheets, on the sheets. The sheet that has passed through the processing unit 138 is discharged to a lower stacking tray 137 by a discharge roller 130.

A conveyance path 133 branches from the conveyance path 121. The conveyance path 133 guides the sheet to a saddle stitching processing unit 800. The saddle stitching processing unit 800 performs finishing processes, such as a folding process that folds the sheets. The saddle stitching processing unit 800 will be described in detail later. The sheet that has been folded in the saddle stitching processing unit 800 is discharged on the lower stacking tray 137 by a pair of folded sheet discharge rollers 136.

Control Configuration

Figure 2:
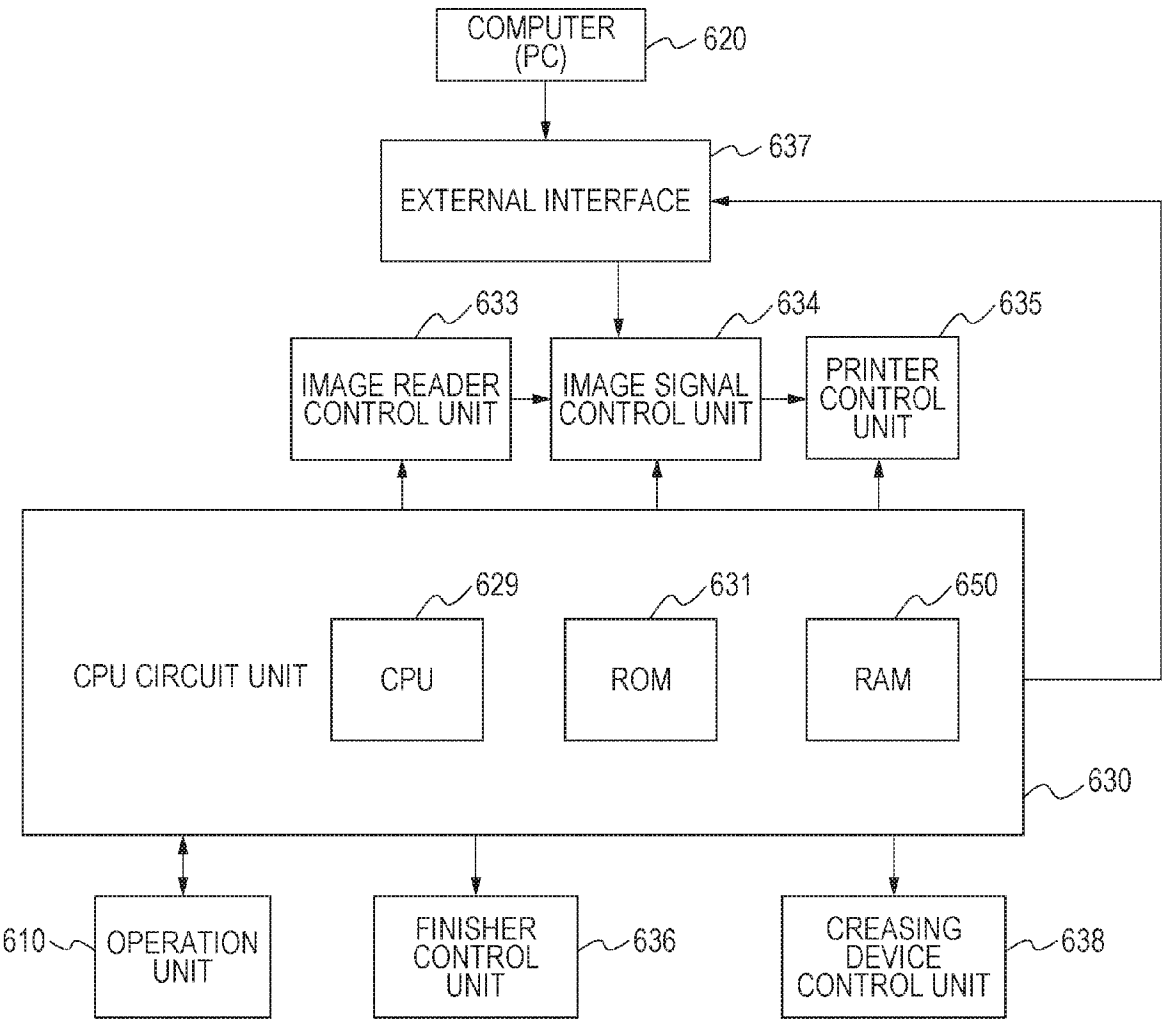
FIG. 2 is a block diagram of the image forming apparatus.
Figure 3:
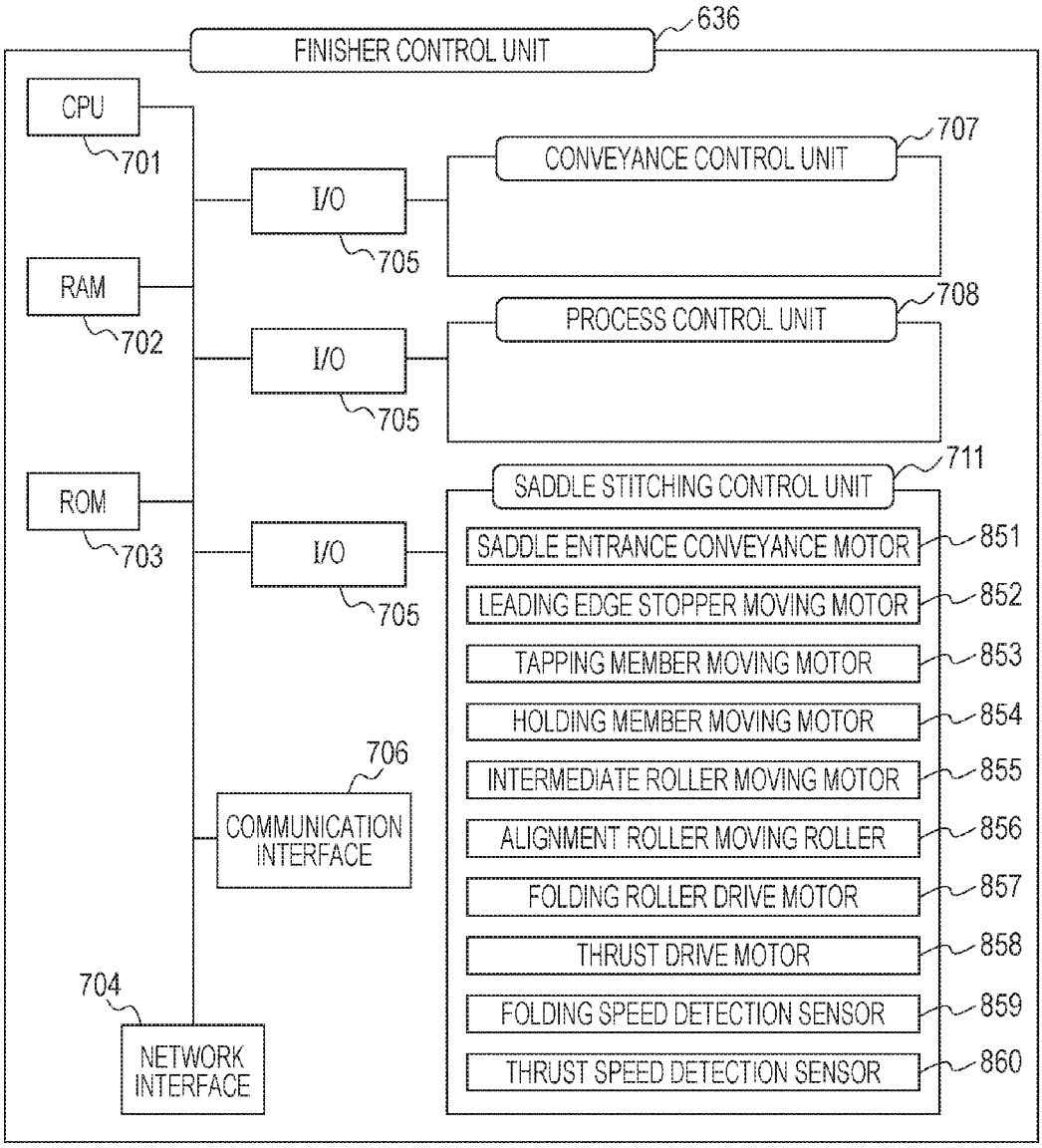
FIG. 3 is a block diagram of a finisher.
Figure 4:
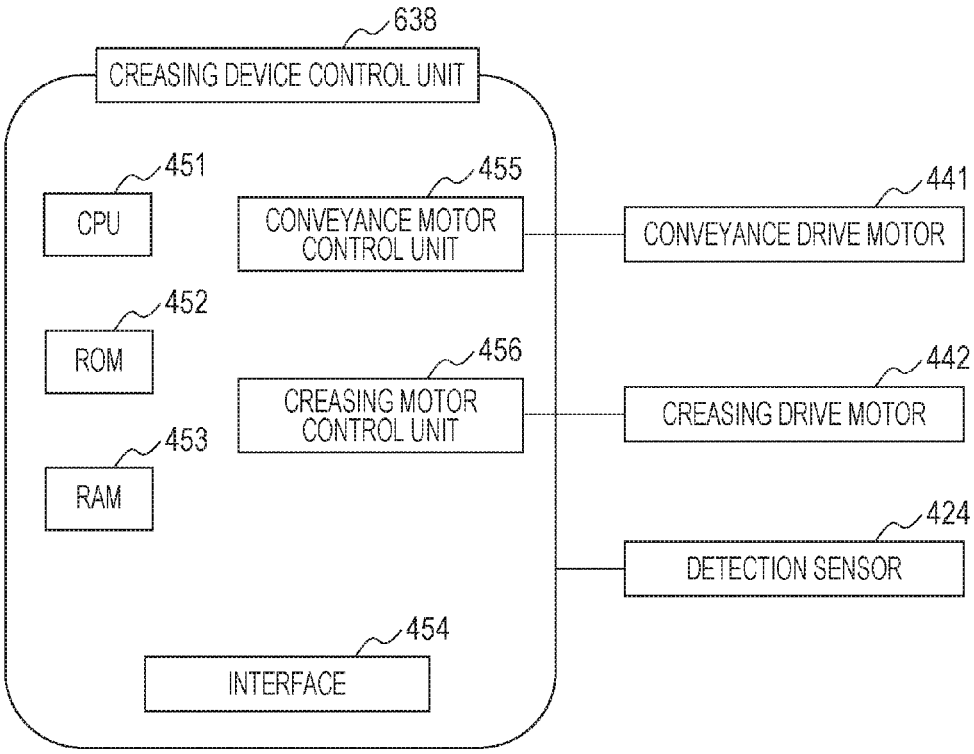
FIG. 4 is a block diagram of a creasing device.

A configuration for controlling the command 1000 according to the present exemplary embodiment will be described with reference to FIGS. 2 to 4. FIG. 2 is a block diagram of a CPU circuit unit 630 that controls the printer 1000 according to the present exemplary embodiment. FIG. 3 is a block diagram of a finisher control unit 636 that is provided in the finisher 100 and that controls the finisher 100. FIG. 4 is a block diagram of a creasing device control unit 638 that is provided in the creasing device 400 and that controls the creasing device 400.

As illustrated in FIG. 2, the CPU circuit unit 630 includes a CPU 629, a ROM 631, and a RAM 650. Furthermore, the CPU circuit unit 630 is electrically connected to an image signal control unit 634, a printer control unit 635, and the finisher control unit 636. The CPU 629 controls the image signal control unit 634, the printer control unit 635, the finisher control unit 636, the creasing device control unit 638, and the like according to a program stored in the ROM 631 and instruction information input from the operation unit 610. The RAM 650 is used as an area for temporarily storing control data and as a work area for calculation associated with the control.

The printer control unit 635 controls the printer main body 600. An external interface 637 is an interface for connecting an external computer 620 and the printer main body 600. For example, the external interface 637 develops print data input from the external computer 620 into an image and outputs image data to the image signal control unit 634. The image data output to the image signal control unit 634 is output to the printer control unit 635 and is formed into an image in the image forming unit 604.

As illustrated in FIG. 3, the finisher control unit 636 includes a CPU (a microcomputer) 701, a RAM 702, a ROM 703, an input/output unit (I/O) 705, a communication interface 706, and a network interface 704. Furthermore, the finisher control unit 636 includes a conveyance control unit 707 that controls a conveying operation of the sheet, and a process control unit 708 that controls the operation of the processing unit 138. Furthermore, the finisher control unit 636 includes a saddle stitching control unit 711 that controls the saddle stitching processing unit 800.

As illustrated in FIG. 4, the creasing device control unit 638 includes a CPU (a microcomputer) 451, a RAM 453, a ROM 452, and an interface 454 for communicating with the CPU circuit unit 630 of the printer main body 600 and the finisher control unit 636. Furthermore, the creasing device control unit 638 includes a conveyance motor control unit 455 that controls a conveyance drive motor 441 that drives the pairs of conveyance rollers 421, 422, and 423. The creasing device control unit 638 includes a creasing motor control unit 456 that controls a creasing drive motor 442 that generates driving force that moves the upper member 412. A signal from the detection sensor 424 is input to the creasing device control unit 638.

Operation of Creasing Device

Figure 5A:
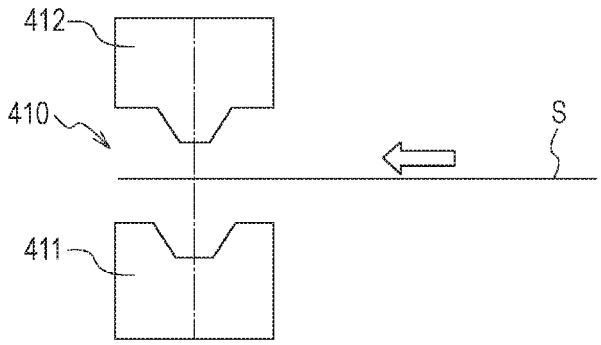
FIGS. 5A to 5C are explanatory drawings of a creasing operation.
Figure 5B:
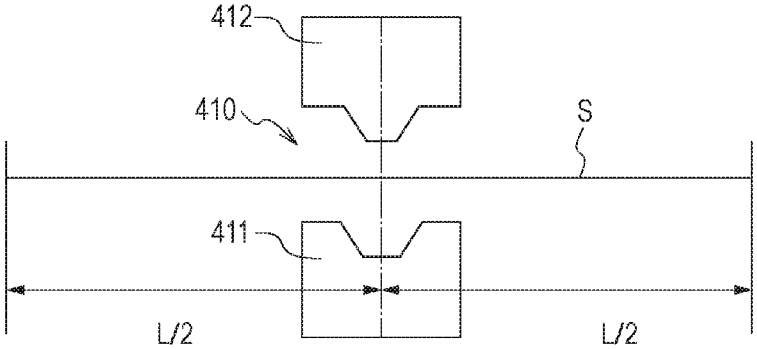
Figure 5C:
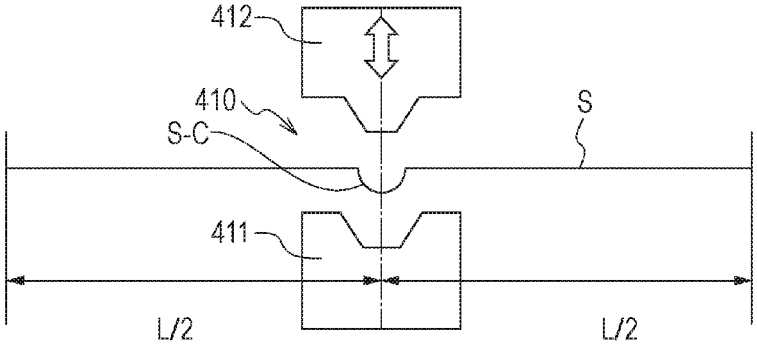

An operation of the creasing device 400 will be described with reference to FIGS. 5A to 5C. As illustrated in FIG. 5A, the sheet S is conveyed between the upper member 412 provided with the projection portion and the lower member 411 provided with the recess portion. Furthermore, as illustrated in FIG. 5B, on the basis of information from the detection sensor 424 and the length of the sheet S in the conveyance direction, the creasing device control unit 638 controls the conveyance drive motor 441 such that the sheet is temporarily stopped at a position in which the middle of the creasing unit 410 and the middle of the sheet S in the conveyance direction coincide each other. The creasing device control unit 638 receives the information on the length of the sheet S in the conveyance direction in advance through communication with the CPU 629.

The creasing device control unit 638 controls the creasing drive motor 442 so that the upper member 412 is lowered. By lowering the upper member 412, a creasing process is performed on the sheet nipped between the upper member 412 and the lower member 411. The upper member 412 is lifted. As illustrated in FIG. 5C, with the creasing process a groove-shaped crease S-C is formed in the sheet. The creased sheet is conveyed once again and is delivered to the finisher 100. With the above operation, the creasing device 400 is capable of performing a creasing process at the middle of the sheet S in the conveyance direction.

Saddle Stitching Processing Unit

A configuration and an operation of the saddle stitching processing unit 800 will be described with reference to FIGS. 7 to 11B.

Schematic Configuration of Saddle Stitching Processing Unit

Figure 7:
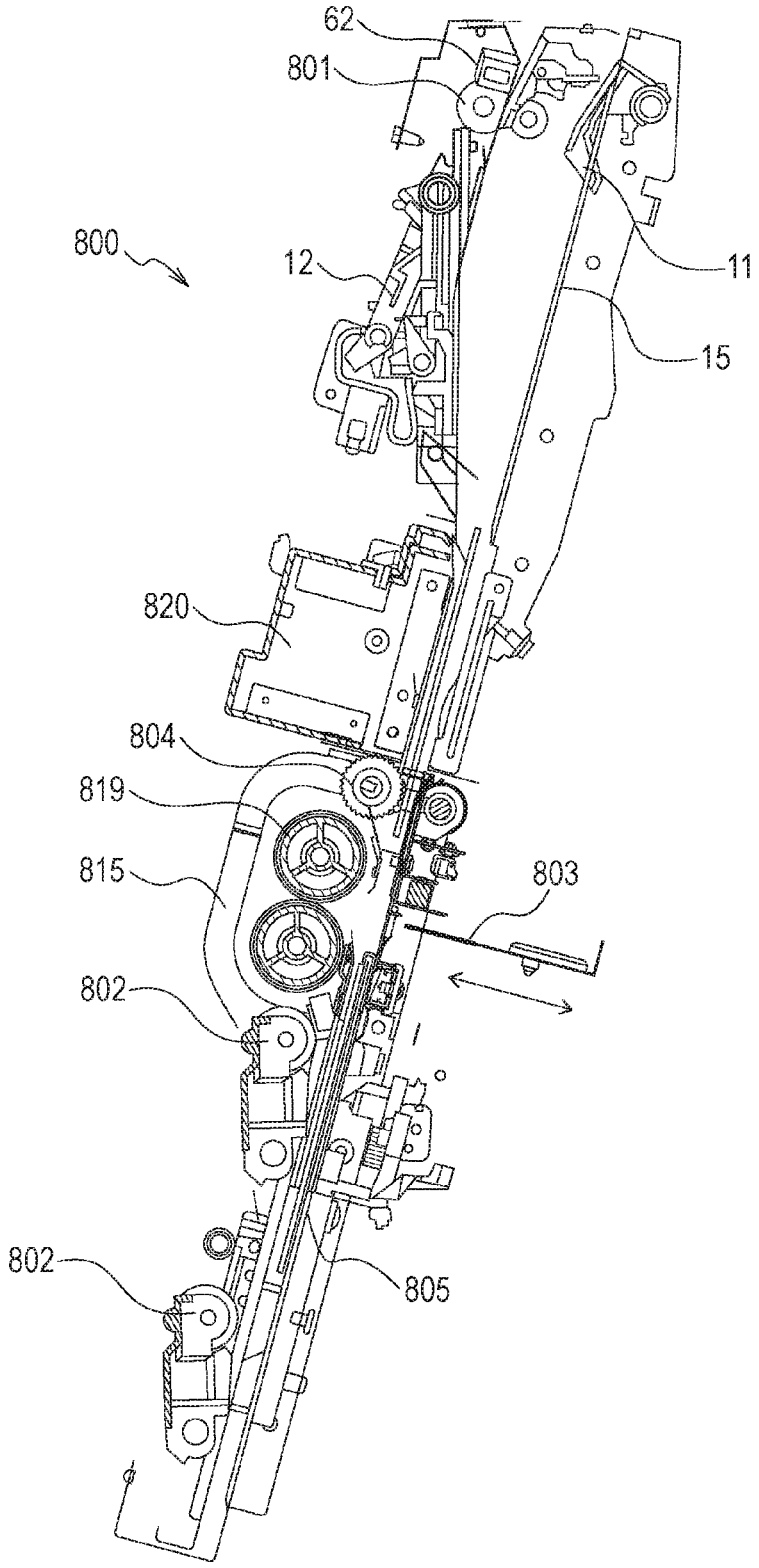
FIG. 7 is a cross-sectional view illustrating a folding processing unit.

FIG. 7 is a cross-sectional view of the saddle stitching processing unit 800. The saddle stitching processing unit 800 includes a processing tray 15 on which the sheet discharged downwards by the entrance roller 801 is loaded. The saddle stitching processing unit 800 further includes a stapler 820 (a binding unit) for binding the stack of sheets, a thrust plate 803 for thrusting the sheet loaded on the processing tray 15, and folding rollers 819 that conveys the sheets that have been thrusted by the thrust plate 803 and that have been folded into two. A leading edge stopper 805 that receives a lower end of the sheet is disposed at a lower portion of the processing tray 15. A trailing edge pressor 11 is disposed at an upper portion of the processing tray 15. A tapping member 12, an intermediate roller 804, and an alignment roller 802 are disposed at positions that oppose the processing tray 15. The entrance roller 801 is driven by a saddle entrance conveyance motor 851, the thrust plate 803 by a thrust drive motor 858 (see FIG. 3), and the folding rollers 819 by a folding roller drive motor 857. The leading edge stopper 805 is driven by a leading edge stopper moving motor 852, and the trailing edge pressor 11 by a holding member moving motor 854. The tapping member 12 is driven by a tapping member moving motor 853, the intermediate roller 804 by an intermediate motor moving motor 855, and the alignment roller 802 by an alignment roller moving motor 856.

Outline of Operation of Saddle Stitching Processing Unit

Figure 8A:
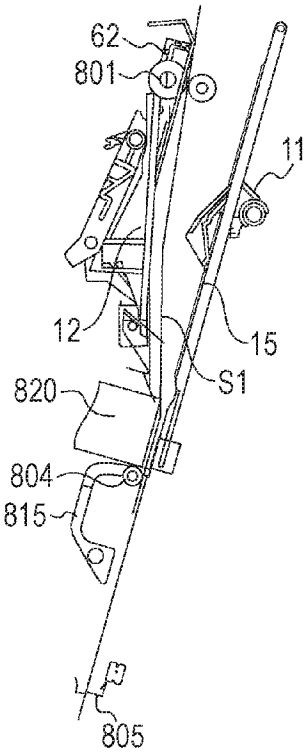
FIGS. 8A to 8E are explanatory drawings of a folding operation.
Figure 8B:
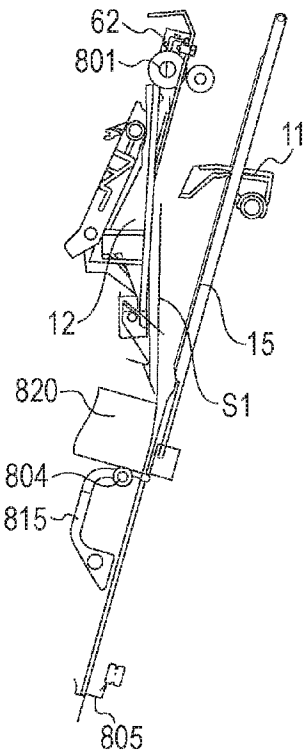
Figure 8C:
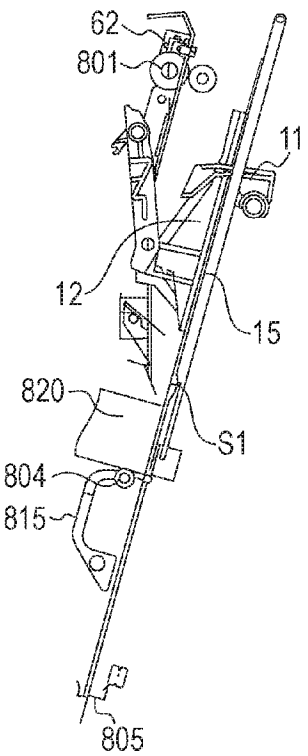
Figure 8D:
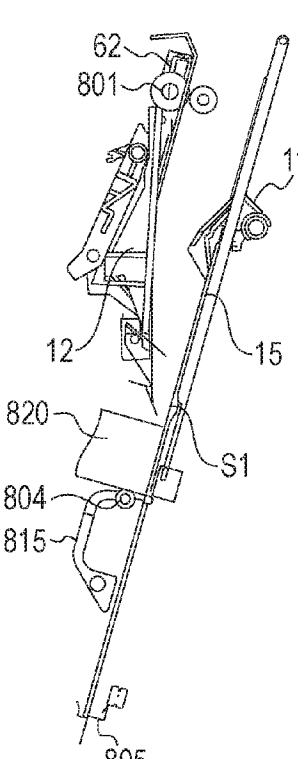

As in FIG. 8A, a sheet S1 conveyed by the entrance roller 801 is conveyed so as to abut against the leading edge stopper 805 serving as a restriction member in the conveyance direction with the intermediate roller 804 and the alignment roller 802. By abutting the leading edge against the leading edge stopper 805, alignment of the sheet in the conveyance direction is performed. Subsequently, alignment in a direction orthogonal to the conveyance direction is performed with an alignment plate 815. Then, as in FIG. 8B, the trailing edge pressor 11 is opened, and as in FIG. 8C, the tapping member 12 urges the sheet S1 towards the processing tray 15. As in FIG. 8D, the trailing edge pressor 11 is closed and the tapping member 12 is returned to a standby position side. In the above state, the next sheet can be received. Urging the sheet trailing edge of the sheet towards the right side in FIG. 8C with the tapping operation and the pressing operation to avoid collision between the trailing edge of the loaded sheet and the leading edge of the next sheet is referred to as a trailing edge sorting.

Figure 8E:
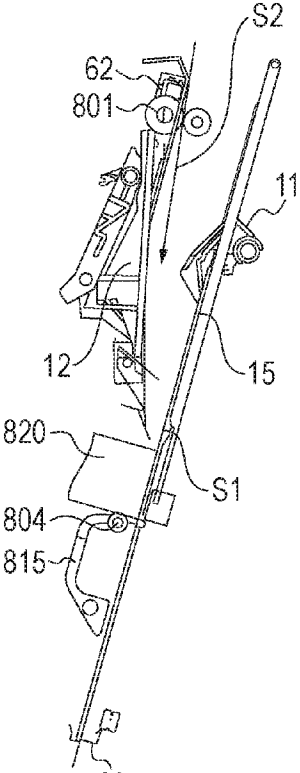
Figure 9:
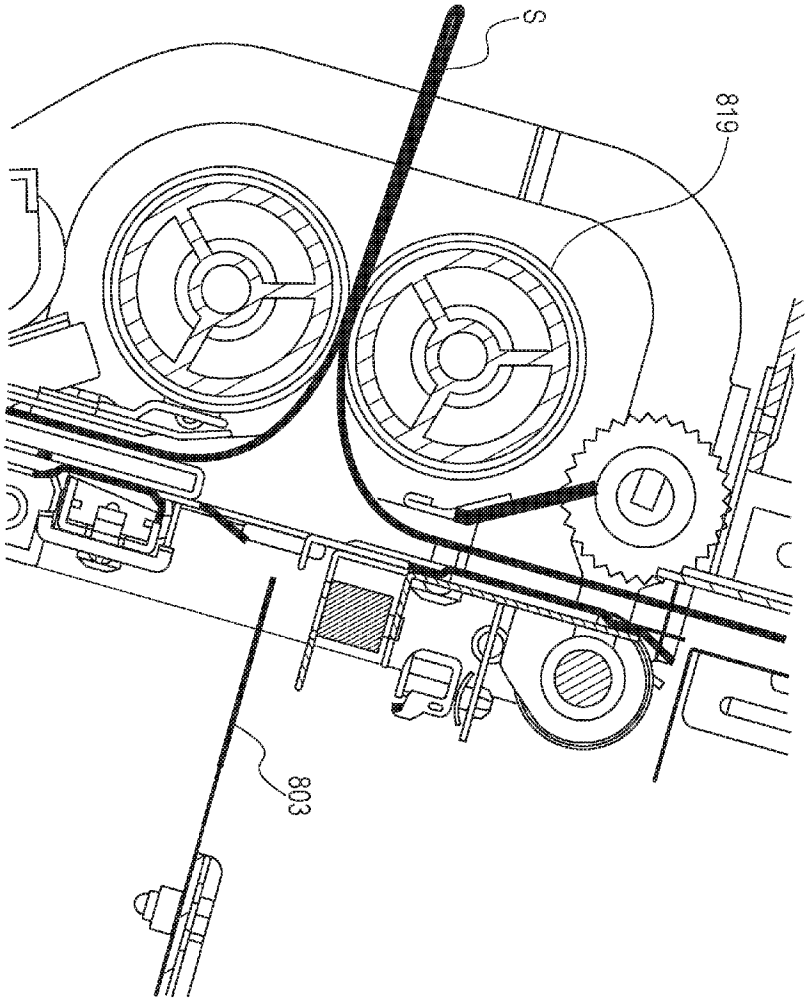
FIG. 9 is an explanatory drawing of a folding operation.

After sorting the trailing edge, as in FIG. 8E, a next sheet S2 is conveyed by the entrance roller 801. Similar to the leading sheet S1, alignment in the conveyance direction and the orthogonal direction is performed. After the trailing edge pressor 11 is opened and the sheet S2 is urged towards the processing tray 15 side with the tapping member 12 the trailing edge pressor 11 is closed. After performing alignment of the sheet, urging of the sheet towards the processing tray 15 side, and the pressing operation on the trailing edge of the sheet to the last sheet Sn, a binding process of the stack of sheets is performed with the stapler 820. Note that the leading edge stopper 805 is at a standby position where the distance from the staple position to the stopper is half the sheet length. The stapler 820 performs a stapling process at the middle of the sheet received by the leading edge stopper 805.

The leading edge stopper 805 is lowered until the stapling position (=the middle portion in the sheet length) of the stack of sheets S on which the stapling process has been performed is the nipping position of the folding rollers 819. As in FIG. 9, the stack of sheets S folded by rotating the folding rollers 819 is formed at the same time as the stack of sheets S is guided to the nip of the folding rollers 819 with the thrust plate 803. Hereinafter, the operation of folding with the folding rollers 819 while thrusting with the thrust plate 803 will be referred to as thrusting and folding. The alignment of each sheet, the stapling process on each stack of sheets, and the thrusting and folding operation are repeated to the last stack of sheets.

Figure 6:
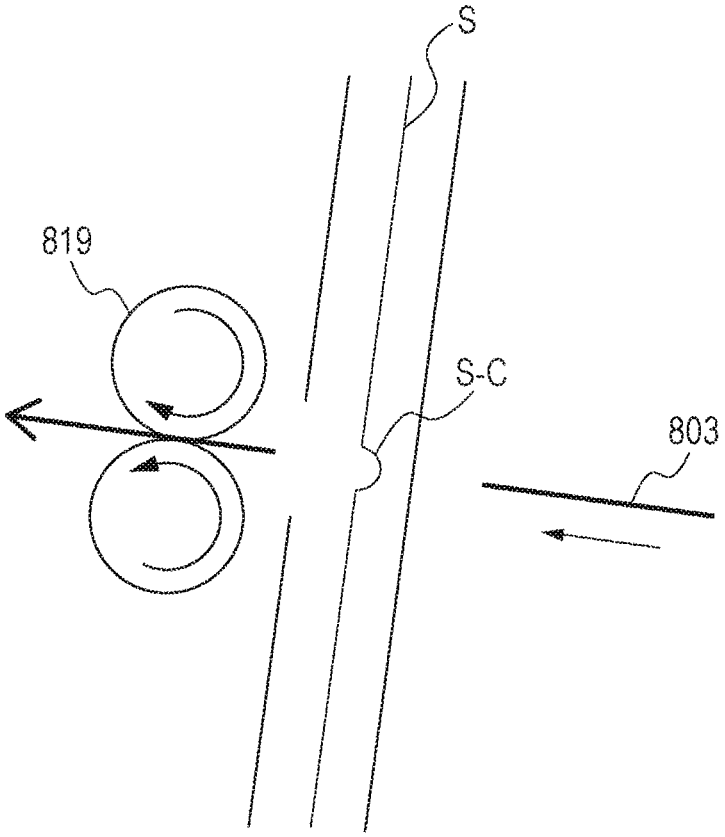
FIG. 6 is a diagram illustrating a relationship between a crease and a thrust plate.

FIG. 6 is a diagram schematically illustrating a state immediately before thrusting with the thrust plate 803. As illustrated in FIG. 6, the crease S-C formed on the sheet with the creasing device 400 protrudes on the side opposite the folding rollers 819, that is, on the thrust plate 803 side.

Configuration Pertaining to Folding Rollers

Figure 10:
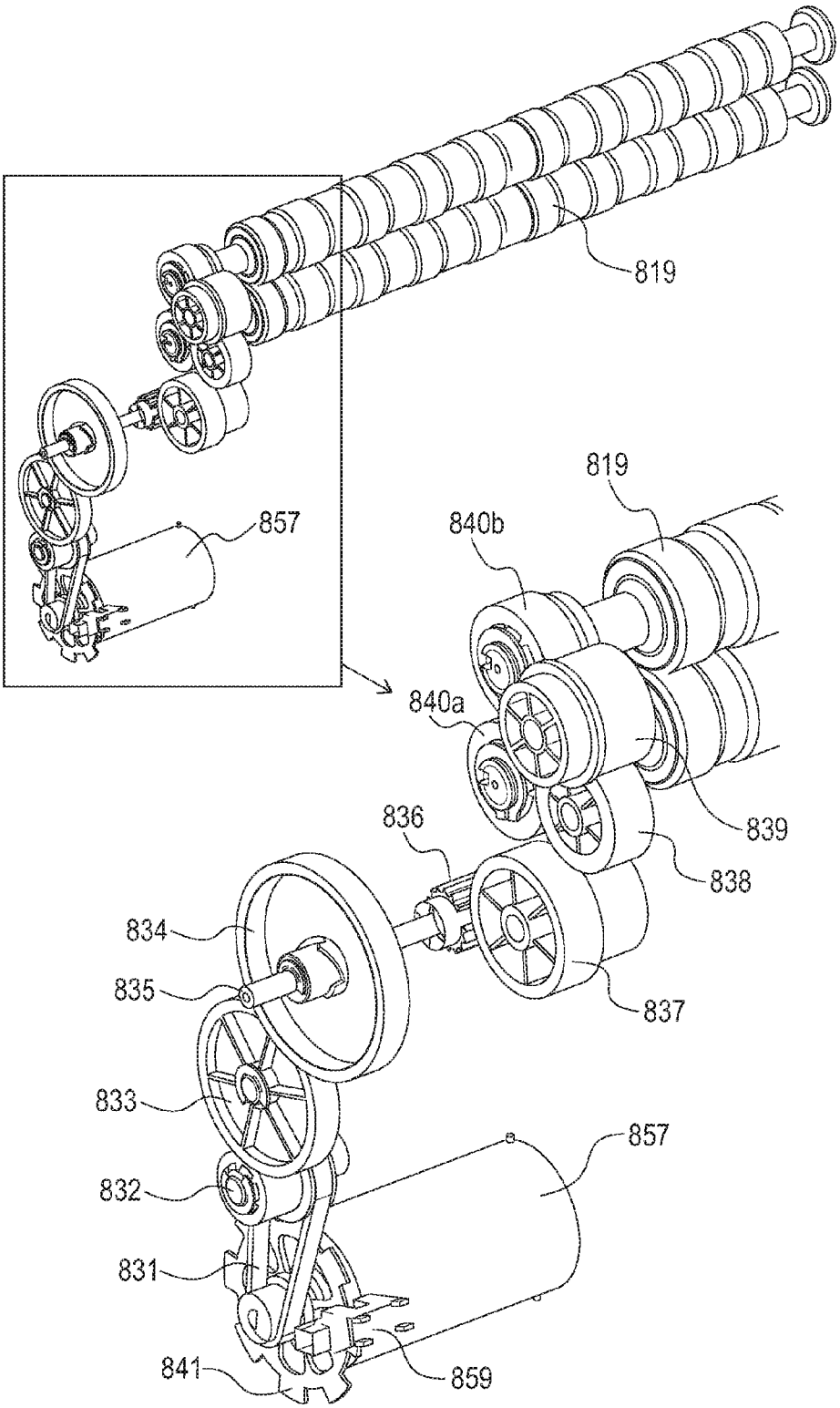
FIG. 10 is an explanatory drawing of a configuration pertaining to folding rollers.

A configuration pertaining to the folding rollers 819 will be described next with reference to FIG. 10. As illustrated in FIG. 10, the folding rollers 819 operate with the folding roller drive motor 857 as the driving source. A drive of the folding roller drive motor 857 is transmitted through a folding drive belt 831, a first folding drive gear 832, and a second folding drive gear 833. Furthermore, the drive of the folding roller drive motor 857 is transmitted through a third folding drive gear 834, a folding drive transmission shaft 835, and a fourth folding drive gear 836. Furthermore, the drive of the folding roller drive motor 857 is transmitted through a fifth folding drive gear 837, sixth folding drive gear 838, and a seventh folding drive gear 839. A rotational drive is transmitted from the sixth folding drive gear 838 to a folding roller drive gear 840*a* that is engaged with the folding roller 819 on the lower side. The rotational drive is transmitted from the seventh folding drive gear 839 to a folding roller drive gear 840*b* that is engaged with the folding roller 819 on the upper side.

Note that the folding roller drive motor 857 is a DC motor, and the driving speed of the folding roller drive motor 857 can be changed by an electric current input by the finisher control unit 636. Furthermore, the finisher control unit 636 monitors the actual rotation speed with an encoder 841 mounted in the folding roller drive motor 857 and a folding speed detection sensor 859. Then, by having the finisher control unit 636 perform a control of feeding back, from the monitoring result, the speed fluctuation into a current value in real time, it will be possible to perform accurate control towards the targeted speed.

Moving Mechanism of Thrust Plate

Figure 11A:
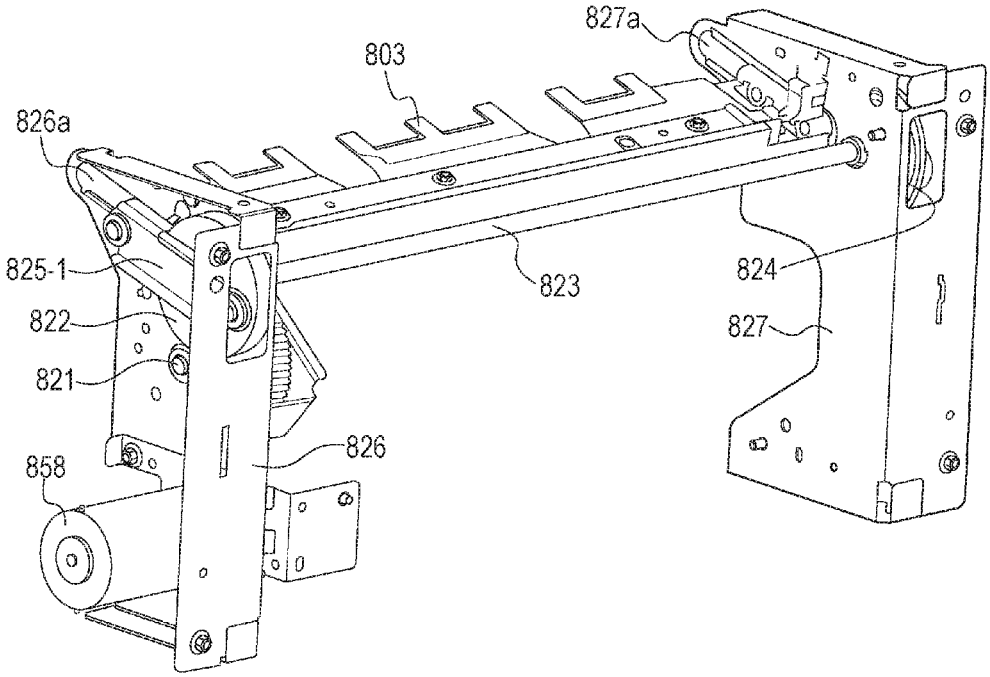
FIGS. 11A and 11B are explanatory drawings of a moving mechanism of the thrust plate.
Figure 11B:
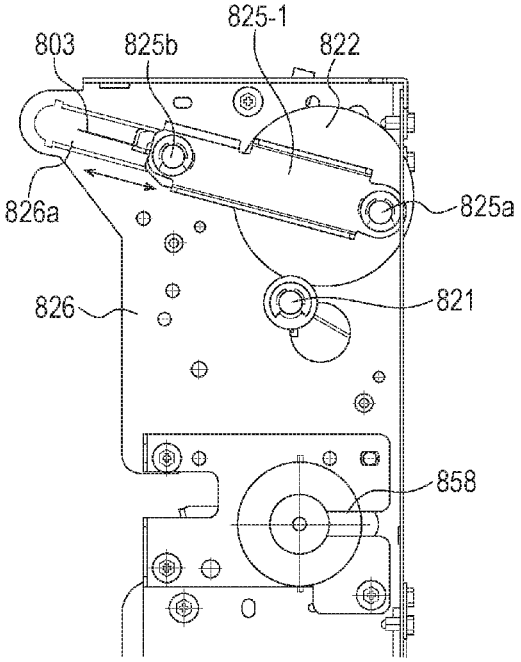

A moving mechanism of the thrust plate 803 will be described with reference to FIGS. 11A and 11B. FIG. 11A is a perspective view of the thrust unit, and FIG. 11B is a side view. As illustrated in FIG. 11A, the thrust plate 803 operates (reciprocates) with the thrust drive motor 858 as the driving source.

The drive of the thrust drive motor 858 is transmitted to a first thrust drive gear 821 and a second thrust drive gear 822 through a gear and a belt (not shown). The second thrust drive gear 822 interlocks with the thrust link cam 824 through a drive shaft 823 and is rotated. The second thrust drive gear 822 is engaged with a thrust link plate 825-1 on the front side, and the thrust link cam 824 is engaged with a thrust link plate 825-2 on the back side. The thrust link plates 825 include link engagement portions 825*a* that engage with the second thrust drive gear 822 and the thrust link cam 824, and thrust plate engagement portions 825*b* that engage with the thrust plate 803. The thrust plate engagement portions 825*b* are guided by a guide portion 826*a* of a front side thrust frame 826 and a guide portion 827*a* of a rear side thrust frame 827.

By being engaged as above, the drive of the thrust drive motor 858 is transmitted into the rotations of the first thrust drive gear 821, the second thrust drive gear 822, and the thrust link cam 824. With the rotations of the second thrust drive gear 822 and the thrust link cam 824, the thrust plate engagement portions 825*b* operate in a direction (a direction of the arrow in FIG. 11B) that is parallel to the guide portions 826*a* and 827*a* of the thrust frames 826 and 827, and the thrust plate 803 operates in the same direction. Note that the thrust drive motor 858 is, similar to the folding roller drive motor 857, a DC motor. The driving speed of the thrust drive motor 858 can be changed with the electric current input by the finisher control unit 636. The folding roller drive motor 857 also includes an encoder (not shown) and a thrust speed detection sensor 860, and similar to the folding roller drive motor 857, performs a control such that the speed becomes uniform by feeding back the speed fluctuation into a current value.

While the current value feedback control through speed monitoring with the folding roller drive motor 857 and the folding roller drive motor 857 is not essential to the present disclosure, mounting thereof is desirable since the speed can be controlled in an accurate manner.

Details of Folding Process

Details of the operation of the folding process will be described with reference to a flowchart in FIG. 12, and FIG. 13. The operation pertaining to FIG. 12 is performed with the finisher control unit 636 controlling the motors through a program stored in the ROM 703 and through the RAM 702 as a work area.

Figure 12:
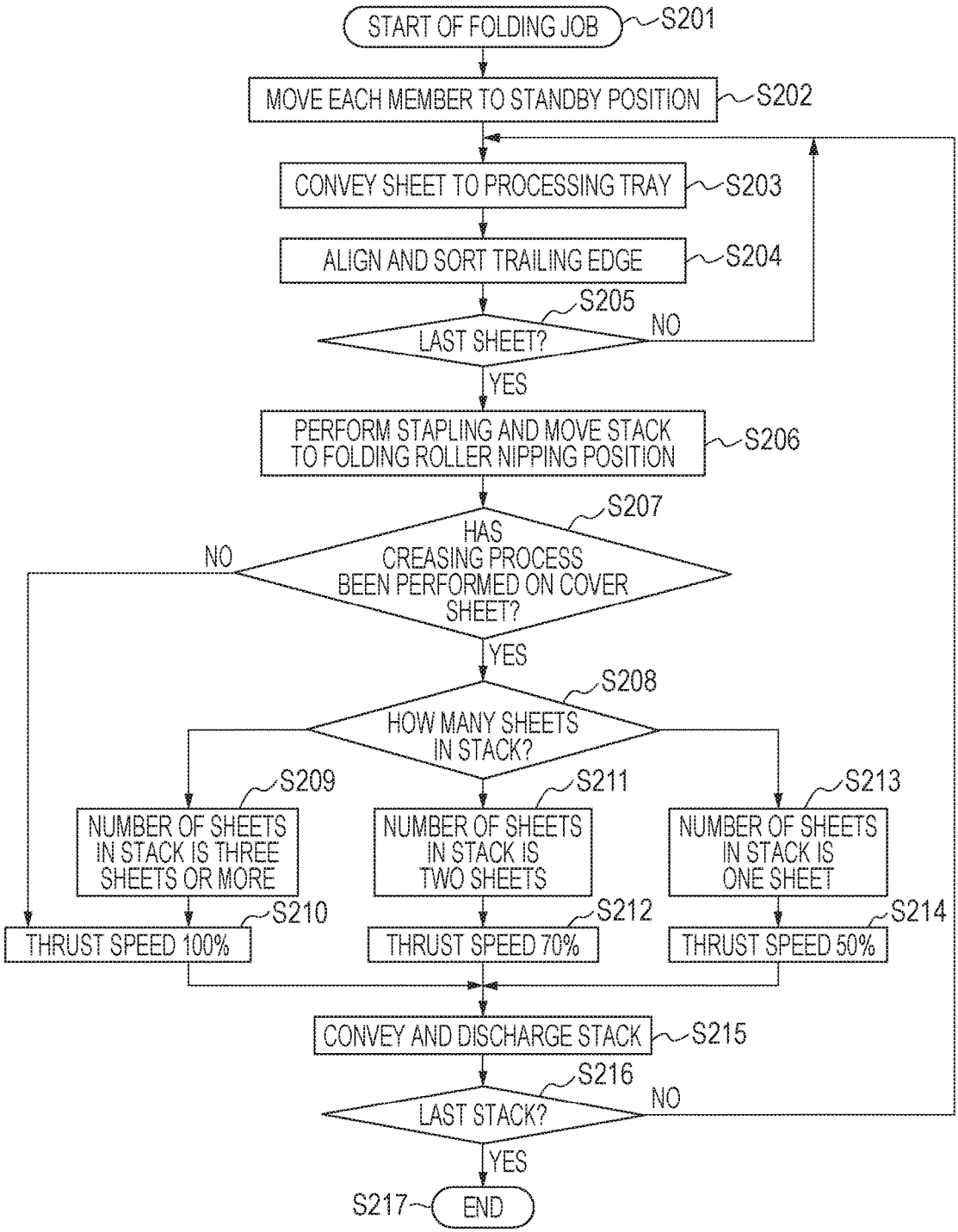
FIG. 12 is a flowchart.

When a folding job is input, the components, such as the alignment plate 815 and the leading edge stopper 805, move to the standby positions that receive the sheet (S201 and 202 in FIG. 12). In other words, the alignment plate 815 stands by at a position that is slightly wider than the sheet width and, as described above, the leading edge stopper 805 stands by at a position that is down by half the sheet length from the stapling position. The sheet that has been delivered by the finisher is conveyed to the processing tray 15 of the saddle stitching processing unit 800 through each conveyance rollers (S203) and the alignment in the sheet conveyance direction, the alignment in the width direction, and the trailing edge sorting operation are performed (S204). The above operation is performed to the last sheet of each stack (S205).

Subsequently, the stapling process is executed by the stapler 820. Note that in a case in which the number of sheets is one, the stapling process is not performed. Furthermore, when no stapling process is set, the stapling process is not performed. Subsequently, the stack of sheets is moved to a position where the middle of the stack of sheets coincides with a nip center of the folding rollers 819 (S206).

When folding a booklet by folding the stack of sheets with the thrust plate 803 and the folding rollers 819, a moving velocity (hereinafter, referred to as a thrust speed) when the thrust plate 803 thrusts the sheet is changed.

First, the finisher control unit 636 checks whether the sheet that is to be the cover sheet among the stack of sheets is a sheet S on which the crease S-C has been formed as illustrated in FIG. 6 (S207). Herein, the sheet that is to be the cover sheet is a sheet that covers the other sheets when folded, and is the sheet that is in contact with the folding rollers 819. The finisher control unit 636 determines whether the sheet is a sheet S on which crease S-C has been formed on the basis of a signal that is transmitted from the printer main body 600. Note that whether to perform a creasing process S-C is input by the user operating the operation unit 610.

When the creasing process has been performed on the sheet, the finisher control unit 636 checks the number of sheets in the stack of sheets (S208). When the creasing process has been performed on the sheet and the number of sheets is three or more (S209), the finisher control unit 636 controls the thrust drive motor 858 so that the thrust speed is 100% (S210).

The thrust speed of 100% is the maximum speed in which the thrust plate 803 moves (370 mm/s in the present exemplary embodiment). Since a conveyance speed (a folding speed) of the folding rollers 819 is 175 mm/s, the thrust speed is a speed that exceeds twice the speed of the folding rollers 819. Note that the conveyance speed of the folding rollers 819 is a circumferential speed of the folding rollers 819.

When the creasing process has been performed on the sheet that is to be the cover sheet and the number of sheets is two, the finisher control unit 636 controls the thrust drive motor 858 so that the thrust speed is 70% (S211 and S212).

When the creasing process has been performed on the sheet that is to be the cover sheet and the number of sheets is one, the finisher control unit 636 controls the thrust drive motor 858 so that the thrust speed is 50% (S213 and S214).

The thrust speed of 50% is 185 mm/s in the present exemplary embodiment. In other words, the thrust speed of 50% is a speed set slightly higher than the conveyance speed (175 mm/s) of the folding rollers 819. If, supposedly, the thrust speed is lower than the conveyance speed of the folding rollers 819, the folding rollers 819 idle on the sheet that is to be the cover sheet. Then, a problem may disadvantageously occur in which the sheet that is to be the cover sheet becomes damaged. Accordingly, in the present exemplary embodiment, the thrust speed is set higher than the conveyance speed of the folding rollers 819 so as to prevent the above problem from occurring.

As described above, when the number of folded sheets is one that is less than a predetermined number of sheets (two), the difference between the conveyance speed of the folding rollers 819 and the thrust speed of the thrust plate 803 is set smaller compared with when the number of sheets is equivalent or more than the predetermined number of sheets (two).

When the finisher control unit 636 determines that no creasing process has been performed on the sheet that is to be the cover sheet (NO in S207), regardless of the number of sheets, the finisher control unit 636 controls the thrust drive motor 858 so that the thrust plate 803 uniformly moves at the thrust speed of 100%.

The booklet that has been formed by performing thrusting and folding in the above manner is conveyed with the folding rollers 819 and the pair of folded sheet discharge rollers 136, and is discharged on the lower stacking tray 137 (S215). The above operation is continued to the last stack and the job is ended (S215 and S216).

As it has been described above, when the creasing process is performed on the sheet, the thrust speed of the thrust plate 803 is changed according to the number of sheets. In detail, the finisher control unit 636 sets the thrust speed of the thrust plate 803 by referring to a table that has been stored in advance and that is associated with the number of sheets folded and with whether a crease has been formed.

By controlling the thrust speed, a back crack, a tear of the cover sheet, and a thrust plate mark, which are described below, can all be prevented from occurring. The tear of the cover sheet is a problem in which, when the stack of sheets is pushed into the nip portion of the folding rollers 819 with the thrusting member, only a sheet (the cover sheet) among the stack of sheets that is in contact with the folding rollers 819 is conveyed by the folding rollers 819 and is torn. The back crack is a problem in which the back portion on the outer side of the folded sheet cracks. The thrust plate mark is a mark that is created when the thrust plate 803 pushes the sheets into the folding rollers 819.

When the number of sheets in the stack of sheets is small, the crease S-C in the sheet, which has been formed by the creasing device 400 by thrusting of the thrust plate 803, may disadvantageously return to a flat state. If the crease S-C of the sheet returns to a flat state, back crack may be created disadvantageously after the sheets are folded. In the present exemplary embodiment, when the number of sheets is small, the thrust speed is low; accordingly, the crease S-C of the sheet formed by the creasing device 400 rarely returns to a flat state due to being thrust by the thrust plate. Accordingly, back cracks can be prevented. Meanwhile, although the thrust speed is low, since the number of sheets is small, tear of the cover sheet does not occur.

Supposedly, if the thrust speed is low when the number of sheets is large, a tear of the cover sheet may disadvantageously occur. However, in the present exemplary embodiment, the thrust speed is high when the number of sheets is large; accordingly, the tear of the cover sheet rarely occurs. Furthermore, since the number of sheets is large, even if the thrust speed is high, the crease S-C of the sheet that is to be the cover sheet does not return to a flat state by being thrusted, back crack can be prevented from being created.

Figure 14:
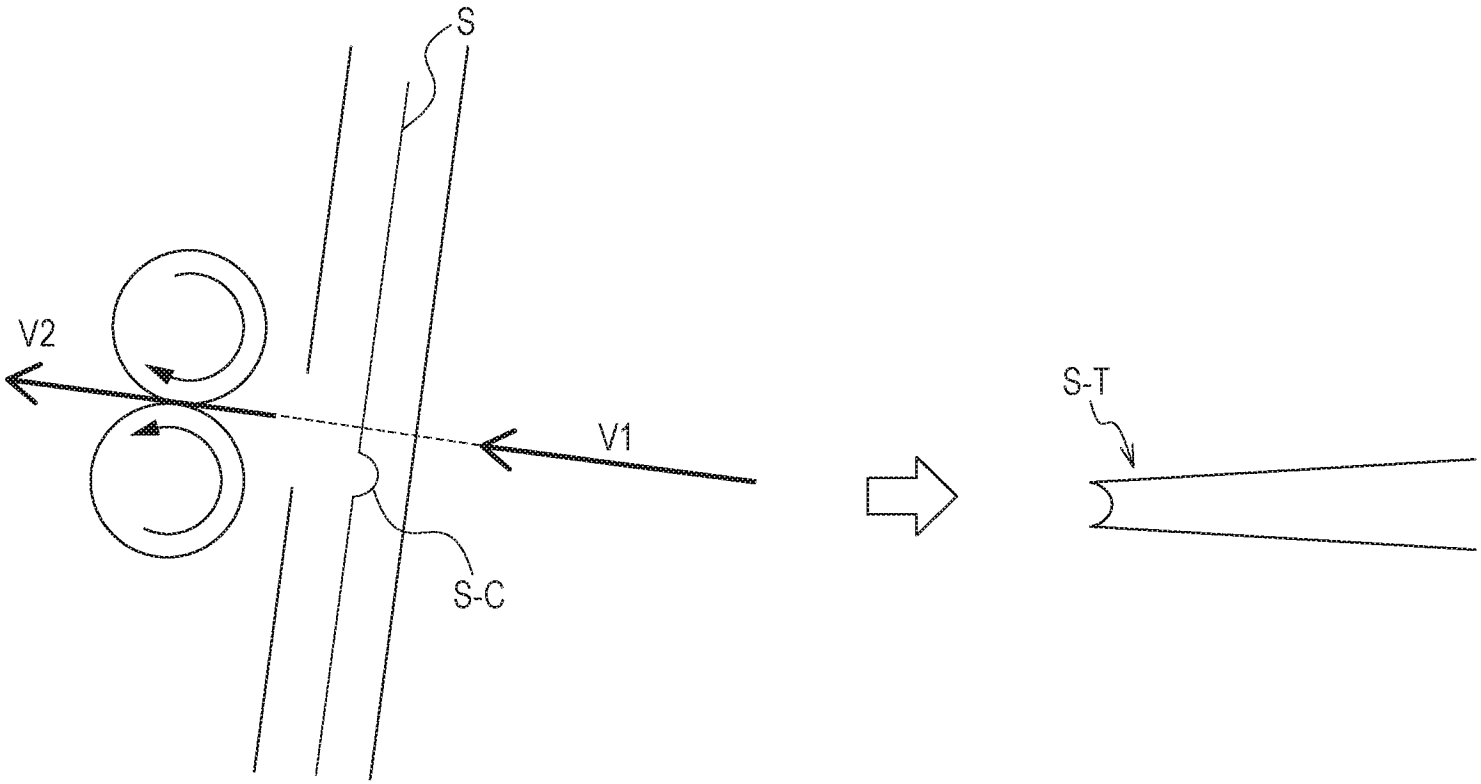
FIG. 14 is an explanatory drawing for describing a thrust plate mark.

When the thrust speed is high, rather than a tip of the thrust plate 803 abutting against the crease S-C that is originally to be the folding position, the tip of the thrust plate 803 deviates from the folding position (the crease S-C) and abuts against a different position such that a mark S-T may disadvantageously occur (see FIG. 14). This mark S-T is referred to as a thrust plate mark. Since the sheet is nipped by the thrust plate 803 and the folding rollers 819, the thrust plate mark occurs on a surface of the sheet that is in contact with the thrust plate 803 and the surface of the sheet that is in contact with the folding rollers 819. In the present exemplary embodiment, when the number of sheets is small, since the thrust speed is at low speed, a thrust plate mark does not easily occur. Furthermore, in the present exemplary embodiment, the thrust speed is at high speed when the number of sheets is large, and it has been revealed through an experiment that when the number of sheets in the stack of sheets is large, no thrust plate mark occurs. The following is thought to be the reason for no thrust plate mark occurring even with a high thrust speed when the number of sheets in the stack of sheets is large. It is thought that when the number of sheets in the stack of sheets is large, the impact to the sheets when the sheets are nipped with the thrust plate 803 and the folding rollers 819 is relieved by air layers between the sheets. Note that when folding the sheets that have no crease S-C formed thereon, the sheets are bent at the portion where the tip of the thrust plate 803 is abutted. Accordingly, no thrust plate mark occurs. Accordingly, in the present exemplary embodiment, in a case of a sheet on which no crease S-C is formed, the thrust speed is set to a high speed regardless of the number of sheets.

As described above, in the present exemplary embodiment, a thrust plate mark, a tear of the cover sheet, and a back crack of the cover sheet can all be prevented.

A result of an experiment conducted while changing the number of sheets and the thrust speed is illustrated in FIG. 13. In FIG. 13, portions surrounded by a thick line is the control employed in the present exemplary embodiment.

In FIG. 13, "○" indicates that the thrust plate mark, the tear of the cover sheet, and the back crack of the cover sheet have not occurred. As illustrated in FIG. 13, in a case in which a crease was formed, the number of sheets was one, and the thrust speed was at 100%, a thrust plate mark and a back crack occurred. In a case in which a crease was formed, the number of sheets was one, and the thrust speed was at 70%, a thrust plate mark occurred. Furthermore, when the number of sheets was three or more and the thrust speed was at 50%, a tear of the cover sheet occurred. Note that the creasing process is for preventing a back crack from occurring. In the present exemplary embodiment, the user selects whether there is to be a creasing process by whether the type of paper is one in which a back crack occurs, for example. Accordingly, in "NO CREASING FORMED" in FIG. 13, the experiment result of whether there was a back crack is omitted.

In the exemplary embodiment described above, an exemplification of a mode in which, rather than changing the conveyance speed of the folding rollers 819, the thrust speed is changed according to the number of sheets in the stack of sheets is given. However, the tear of the cover sheet, the thrust plate mark, and the back crack occur due to the speed difference between the conveyance speed of the folding rollers 819 and the thrust speed. Accordingly, the speed difference between the conveyance speed of the folding rollers 819 and the thrust speed may be changed according to the number of sheets in the stack of sheets by, for example, as illustrated in a modification below, not changing the thrust speed but by changing the conveyance speed of the folding rollers 819.

The modification will be described below. Regardless of the number of sheets in the stack of sheets, the thrust speed of the thrust plate 803 is set to 370 mm/s. Furthermore, when folding the sheets on which a crease has been formed, the speed of the folding rollers 819 is changed according to the number of sheets in the stack of sheets such that the speed difference with the thrust speed in a case in which the number of sheets is large is larger than the speed difference with the thrust speed in a case in which the number of sheets is small.

Specifically, when the number of folded sheets is three or more, the speed of the folding rollers 819 is set to 175 mm/s. When the number of folded sheets is two, the speed of the folding rollers 819 is set to 286 mm/s. When the number of folded sheets is one, the conveyance speed of the folding rollers 819 is set to 360 mm/s. When sheets on which no crease has been formed are folded, regardless of the number of sheets in the stack of sheets, the thrust speed is set to 370 mm/s and the conveyance speed of the folding rollers 819 is set to 175 mm/s.

Furthermore, when the sheets on which a crease has been formed are folded, since it is only sufficient that, in accordance with the number of sheets in the stack of sheets, the speed difference between the speed of the folding rollers 819 and the thrust speed is changed with respect to the speed difference when the number of sheets is small, both of the speed of the folding rollers 819 and the thrust speed may be changed according to the number of sheets in the stack of sheets.

Furthermore, in the description above, an exemplification of a mode in which information of whether a creasing process has been performed on the sheet is transmitted by the creasing device 400 to the finisher 100 through the CPU 629 to switch the control in the finisher 100. In other words, an exemplification of a configuration in which the creasing device 400 and the finisher 100 are separable and are capable of each being provided with a control unit has been given. However, the configuration may be as below. That is, the creasing unit 410 is provided inside the finisher 100. Furthermore, the control unit inside the finisher 100 may control the operation of the creasing unit 410 and control the speed of the folding rollers 819. Furthermore, the CPU circuit unit 630 of the printer main body 600 may directly control the saddle stitching processing unit 800.

Furthermore, in the description above, an exemplification of a mode in which the protrusion of the crease S-C formed by the creasing device 400 is oriented towards the inner side when the sheets are folded has been given. However, the protrusion of the crease S-C formed by the creasing unit may be oriented towards the outer side when the sheets are folded. In other words, even when the protrusion of the crease S-C formed by the creasing device 400 is oriented towards the outer side when the sheets are folded, it is effective in preventing a back crack of the cover sheet from occurring.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-181160, filed Sep. 14, 2015, which is hereby incorporated by reference herein in its entirety.

What is claimed is:

1. A sheet processing apparatus, comprising:

a supporting unit arranged to support a sheet;

a folding roller arranged to fold the sheet supported by the supporting unit while rotating at a folding speed;

a thrusting member arranged to move at a thrust speed, which is higher than the folding speed, and to thrust the sheet supported by the supporting unit towards the folding roller; and a control unit arranged to control the thrusting member and the folding roller such that a speed difference between the folding speed of the folding roller and the thrust speed of the thrusting member, in a case in which the folding roller folds a first number of sheets, is smaller than the speed difference between the folding speed of the folding roller and the thrust speed of the thrusting member, in a case in which the folding roller folds a second number of sheets, the second number of sheets being larger than the first number of sheets.

2. The sheet processing apparatus according to claim 1, wherein the control unit is arranged to control the thrusting member such that the thrust speed of the thrusting member increases with an increase in the number of sheets to be folded by the folding roller.

3. The sheet processing apparatus according to claim 2, wherein the control unit is arranged to maintain the folding speed of the folding roller unchanged regardless of the number of sheets to be folded.

4. The sheet processing apparatus according to claim 1, wherein the control unit is arranged to control the folding roller such that the folding speed of the folding roller decreases with an increase in the number of sheets to be folded.

5. The sheet processing apparatus according to claim 4, wherein the control unit is arranged to maintain the thrusting speed of the thrusting member unchanged regardless of the number of sheets folded.

6. The sheet processing apparatus according to claim 1, wherein the control unit is arranged to set the speed difference by referring to a table stored in advance, the table being defined between the number of sheets that are to be folded and the speed difference.

7. The sheet processing apparatus according to claim 1, further comprising a binding unit arranged to bind the sheets, wherein the thrusting member is arranged to thrust the sheets which have been bound by the binding unit.

8. The sheet processing apparatus according to claim 1, further comprising a creasing unit arranged to form a crease on the sheet;

wherein the control unit arranged to control the thrusting member and the folding roller such that the speed difference, in a case in which the folding roller folds the first number of sheets including the sheet on which the crease has been formed, is smaller than the speed difference, in a case in which the folding roller folds the second number of sheets including the sheet on which the crease has been formed.

9. The sheet processing apparatus according to claim 8, wherein in a case that the folding roller folds sheets that do not include the sheet on which the crease is formed, the control unit is arranged not to change the speed difference regardless of the number of sheets to be folded by the folding roller.

10. The sheet processing apparatus according to claim 8, wherein the control unit is arranged to control the thrusting member and the folding roller such that the speed difference, in a case in which the folding roller folds sheets including a sheet on which the crease is formed is smaller than the speed difference in a case in which the folding roller folds sheets not including a sheet on which the crease is folded.

11. The sheet processing apparatus according claim 8, wherein the apparatus is arranged such that the sheet on which the crease has been formed is a sheet that comes in contact with the folding roller when in use, and wherein the crease formed on the sheet is a crease protruding on a side of the sheet opposite the folding roller.

12. The sheet processing apparatus according to claim 8, further comprising:

a conveyance path arranged to convey the sheet on which the crease is formed by the creasing unit to the supporting unit.

13. An image forming apparatus, comprising:

an image forming unit arranged to form an image on a sheet;

a supporting unit arranged to support a sheet;

a folding roller arranged to fold the sheet supported by the supporting unit while rotating at a folding speed;

a thrusting member arranged to move at a thrust speed, which is higher than the folding speed, and to thrust the sheet supported by the supporting unit towards the folding roller; and a control unit arranged to control the thrusting member and the folding roller such that a speed difference between the folding speed of the folding roller and the thrust speed of the thrusting member, in a case in which the folding roller folds a first number of sheets, is smaller than the speed difference between the folding speed of the folding roller and the thrust speed of the thrusting member, in a case in which the folding roller folds a second number of sheets, the second number of sheets being larger than the first number of sheets.

* * * * *